US006000995A

United States Patent [19]

Ruholl

[11] Patent Number: 6,000,995

[45] **Date of Patent: *Dec. 14, 1999**

[54] UNIT FOR THE DOSAGE OF GRAINED, POURABLE MATERIALS, IN PARTICULAR BLASTING ABRASIVES

[75] Inventor: Heinz Ruholl, Emsdetten, Germany

[73] Assignee: Heinrich Schlick, Greven, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,813

[22] Filed: Nov. 6, 1996

[30] Foreign Application Priority Data

Nov. 6, 1995 [DE] Germany ..... 195 41 228

[51] Int. Cl.[6] ..... B24C 3/00; B65G 33/26; B65G 51/16

[52] U.S. Cl. ..... 451/2; 451/99; 451/100; 198/548; 198/661; 406/19; 406/31

[58] Field of Search ..... 222/61, 221, 412, 222/413; 239/336, 379, 314; 406/19, 29, 31, 113, 115, 124; 451/2, 99, 100, 101, 446, 102; 137/116.5; 366/186; 198/46.71, 1, 545, 548, 550.6, 550.1, 661, 665, 675; 241/34

[56] References Cited

U.S. PATENT DOCUMENTS

| | | | |
|---|---|---|---|
| 710,879 | 10/1902 | Mitchell . | |
| 825,381 | 7/1906 | Coleman | 451/101 X |
| 1,192,250 | 7/1916 | Weyant . | |
| 2,352,749 | 7/1944 | Wills . | |
| 2,365,250 | 12/1944 | Crowley . | |
| 2,507,245 | 5/1950 | Dady . | |
| 2,520,566 | 8/1950 | Sargrove . | |
| 2,714,563 | 8/1955 | Poorman et al. | 451/2 X |
| 3,019,895 | 2/1962 | Loevenstein et al. . | |
| 3,220,574 | 11/1965 | Sefcheck . | |
| 3,521,407 | 7/1970 | Nalley et al. | 451/2 |
| 3,702,128 | 11/1972 | Trotter, Jr. . | |

(List continued on next page.)

FOREIGN PATENT DOCUMENTS

| | | | |
|---|---|---|---|
| 0 407 197 A2 | 9/1991 | European Pat. Off. . | |
| 0 578 132 | 1/1994 | European Pat. Off. . | |
| 0 578 132 B1 | 1/1994 | European Pat. Off. . | |
| 96/04851 | 5/1997 | European Pat. Off. . | |
| 86/00029 | 8/1986 | France . | |
| 3131002 A1 | 3/1983 | Germany . | |
| 232413 | 1/1986 | Germany | 451/102 |
| 195 41 228 | 8/1997 | Germany . | |
| 4-57671 | 2/1992 | Japan . | |
| 575-212 | 10/1977 | Russian Federation . | |
| 575212 | 10/1977 | U.S.S.R. | 451/100 |
| 1011822 | 12/1965 | United Kingdom . | |
| 2 146 807 | 9/1984 | United Kingdom . | |
| 2182 628A | 11/1986 | United Kingdom . | |
| 2 182 628 | 5/1987 | United Kingdom . | |
| 89/00201 | 9/1989 | United Kingdom . | |
| 86/04536 | 8/1986 | WIPO | 451/101 |
| 89/08007 | 9/1989 | WIPO | 451/2 |

OTHER PUBLICATIONS

Brochure about Enders & Hauser "Granucor".

Wolfgang Siegel, "Pneumatische Förderung" ("Pneumatic Conveyor Technology"), published by Vogel Fachbuch, pp. 187–201.

*Primary Examiner*—Timothy V. Eley
*Attorney, Agent, or Firm*—Pillsbury Madison & Sutro LLP

[57] ABSTRACT

A dosage device for feeding grained, pourable materials, particularly abrasive blasting materials. Feeding is accomplished by use of a dosage auger that employs a screw mechanism that either decreases or increases relative to the distance between the incline of the spiral wings. The device also includes an adjustable drive, a flow measuring device to monitor and control flow rates and a mixing chamber to assure full mixing of abrasive material in a compressed air stream.

19 Claims, 5 Drawing Sheets

U.S. PATENT DOCUMENTS 3,768,210 10/1973 Johnson et al. ..... 451/101 X
4,015,734 4/1977 Laidig .
4,036,411 7/1977 Westhoff .
4,377,364 3/1983 Weaver .
4,386,695 6/1983 Olson .
4,391,561 7/1983 Smith et al. .
4,449,332 5/1984 Griffiths ..... 451/102
4,693,102 9/1987 Amy et al. ..... 451/2 X
4,945,688 8/1990 Yie ..... 451/101 X
4,970,830 11/1990 Schlick .
5,024,029 6/1991 Abbott et al. .
5,099,619 3/1992 Rose ..... 451/102 X
5,107,630 4/1992 Lodewijk ..... 451/101 X
5,122,263 6/1992 Huber .
5,167,320 12/1992 Lucich et al. .
5,242,122 9/1993 Bogen ..... 241/34 X
5,255,853 10/1993 Munoz ..... 451/102 X
5,256,703 10/1993 Hermann et al. .
5,353,554 10/1994 Keizers .
5,361,996 11/1994 Svensson et al. ..... 241/34 X
5,407,379 4/1995 Shank et al. ..... 451/101 X
5,591,064 1/1997 Spears, Jr. ..... 451/2

N
S1 S2 S3 S4 S5 S6 S7 S8

UNIT FOR THE DOSAGE OF GRAINED, POURABLE MATERIALS, IN PARTICULAR BLASTING ABRASIVES

BACKGROUND OF THE INVENTION

1. Field of the Invention

The invention concerns a unit for the dosage of grained, pourable materials, in particular blasting abrasives, for a processing of workpieces, large surfaces or the like.

2. Description of Related Art

A unit of the above mentioned kind is known from the EP-A-0 578 132. An abrasive feeding device is arranged beneath a vessel which is filled with abrasive. The feeding device consists of a tube in which a dosage auger is installed. The abrasive transported by the auger falls through a tube arranged at the end of an outfeed area. At the tube there is a flow measuring device which transfers received measuring signals to an evaluation unit which evaluates the measuring signals and compares the result with nominal values. The rotation speed of the dosage auger is set by means of these results.

It is disadvantageous that although the metering screw has a double-lead screw, not all granular flowable materials can be processed. Even when the dosage auger has double spiral wings, this is not sufficient for the use of all grained, pourable materials for the treatment process. Very fine materials behave similar to flour. The double spiral wings of the dosage auger with its tapering end does not operate well with a uniform dosage, but presses the flour like materials together so that the abrasive passes in lumps through the downpipe. Thus, the function of the flow measuring device and the evaluation unit is severely disturbed. The flow measuring device determines highest and lowest material densities so that the evaluation unit sets the dosage auger to zero or to a maximum speed.

Furthermore, the transport of the materials coming out of the downpipe to the blast nozzle has to be improved. Since the arriving materials are only blown away, a single and directed effect of each grain is not achieved.

U.S. Pat. No. 2,536,250 discloses a cleaning unit where a mixing link is arranged beneath an abrasive feeding device of an abrasive collecting hopper. The mixing link consists of a cross and a longitudinal boring which are connected to a mixing chamber. In this boring a nipple is mounted which is arranged with its tip behind the connecting point of the cross boring, i.e., outside the mixing chamber, and thus ends before an adaptor. A line with a relatively big diameter is connected to the adapter.

It is a disadvantage that the compressed air streaming into the mixing chamber only creates a vacuum towards the abrasive flowing into the mixing chamber. The abrasive is aspirated by the vacuum and pressed into the line. For the support of the transport capacity of the mixing chamber, the longitudinal boring must be directed downwards since the transport pressure on the line is so small that the line length and thus the effectivity of the abrasive is limited. In order to achieve the abrasive's cleaning effect at least steam must be added.

GB-A-182,628 discloses a shot peening device which includes a dosage auger with one inlet which is fed with granulate media by a hopper. The dosage auger is driven by a step motor in order to advance the media fed into the infeed with an exactly controlled speed to an outfeed line. The motor is controlled by a computer so that a programmed quantity comes out of the outfeed line. A capacitive proximity switch is provided in the outfeed line in order to determine whether the outfeed is blocked.

It is also not possible to use all materials, even those which are not similar to flour, without malfunctions in this unit. Furthermore, the materials are only blown away after leaving the dosage auger, so that the single grain cannot achieve its full efficiency which, however, is absolutely necessary for shot peening processes.

EP-A-0 218869 discloses a unit for the uniform dosage of grained abrasive for pneumatically operating blast machines. This unit stores abrasive in a closed vessel. A dosage auger is arranged beneath an outlet of the vessel. The dosage auger turns in a horizontal tube. Thereby, the infeed area of the dosage auger receives abrasive material and feeds it to the outfeed area. At one end the auger tube is connected to ducting in which the abrasive is fed. Since the ducting is pressurized the abrasive is carried along and directed to the blast nozzle. To assure that the abrasive being fed is uniform, a unit is provided which balances the pressure drop from the inside of the closed vessel to the inside of the auger tube up to the feeding line.

However, in order to be able to process all materials and to achieve its full efficiency, the present means to render the material uniform are not sufficient.

Thus, there is the task to continue the development of a unit for the dosage of grained, pourable materials, in particular abrasives, so that all material configurations can be used to full efficiency.

This task is solved by the features of the present invention.

SUMMARY OF THE PRESENT INVENTION

The advantages achieved by the invention are that the material, in particular abrasives, are efficiently mixed with the arriving compressed air which avoids a varied material concentration at the blast nozzle. Furthermore, each single grain of the material is "freed" and directed to the blast nozzle under high speed. Due to the adjustability of the driving nozzle, the mixing chamber can be adapted to different materials. According to the material being fed, the driving nozzle is moved into or out of the mixing chamber so that a changeable mixing chamber is created. A diffusor assures that the material/air mixture achieves a high blasting speed.

The dosage device can be designed as a vibrating conveyor or as a dosage auger.

It is advantageous when the dosage auger is provided with double spiral wings so that its incline to the outfeed area can be changed; furthermore it is tapering from the beginning of the wing incline to its end.

Owing to the reversible incline of the dosage auger, it is possible to transport grained, pourable materials of all configurations. The incline of the double spiral wings can be designed in two versions.

In the first version, the incline continuously decreases from the beginning to the end under diminution of first sections.

In the second version, the incline continuously increases from the beginning to the other end with enlarging sections between the screws or spiral wings.

Furthermore, the arrangement of the dosage augers can be reversed within the auger tube so that the beginning incline becomes the end incline and vice versa.

If common grained and pourable materials are used, the first version of the dosage auger will be chosen. The abrasive is compressed and the uniform dosage in the outfeed area is favored by the continuous diminution of the wing sections, due to the incline tapering.

If flour like grained and pourable materials are used, a dosage auger of the second version will be positioned with the beginning incline of the double spiral wings being located beneath the infeed area. Due to this new incline position, the arriving flour like material, in particular abrasive, falls on the smaller sections of the dosage auger. Due to the use continuously increasing sections between the double spiral wings, the material will lay more flatly in the single sections and existing cloggings are surely removed. It is of special importance that special abrasives for fine blasting operations can, hereby, be efficiently used. Another important advantage is that the whole abrasive can be efficiently "washed out" by this new position of the incline of the double spiral wings. In order to be able to securely reproduce already effected blastings, the used abrasive must be completely removed from the machine before a new abrasive will be used. This is done by compressed air. Since the conically tapered beginning of the auger is positioned in the infeed area and the conically enlarged auger end in the outfeed area, there is no resistance against the compressed air flowing through the abrasive infeed unit. The reversed course of the double spiral wings cause an even stronger efficiency of the compressed air. Thus, all abrasive residues are removed.

In order to be able to "wash out" the dosage auger of the first version, it is positioned in an auger tube so that instead of the incline beginning, the incline end is placed beneath the infeed area. Due to the enlarging sections of the double spiral auger, there is also no resistance against the compressed air so that the reversed course of the double spiral wings cause an even stronger efficiency of the compressed air, too. Thus, all abrasive residues are removed.

Which dosage auger will be used during blasting is decided by a test run of the user or by past experiences gained.

It is preferable to connect a pressure balancing line to the first vessel, to the abrasive infeed unit and to the driving nozzle of the mixing chamber. The pressure balancing line serves for a uniform flow of the material, in particular of the abrasive.

In order to assure a continuous blast operation, a second vessel is arranged above the first. This second vessel allows the refilling of material, in particular abrasive, during a running blast operation without influencing the quality of this operation or to continue the blast process without interruption.

It is preferable to connect the first vessel, the second vessel and the driving nozzle to one compressed air line so that the whole installation can be operated by one compressed air source.

In order to make the driving nozzle adjustable, you can arrange a threaded ring at the rear chamber wall which is adjustable by an outer thread arranged on the driving nozzle.

The material connecting point between downpipe and chamber tube can be designed as, material infeed connection. This guarantees that the arriving abrasive can fall into the mixing space of the mixing chamber. However, the material connecting point between the downpipe and the chamber tube can also be designed as a material infeed double hopper which allows a desired concentration of material arriving from the downpipe. It should be noted that the smaller the cross section from hopper inlet to hopper outlet, the earlier a material concentration becomes possible. Furthermore, the use of the double hopper has a dosing function so that when the abrasive dosage by the dosage auger fails, a temporary source of additional dosage can be provided by this hopper.

The diffusor supply insert is divided into a diffusor and a subsequent mixing tube. The diffusor is arranged behind the mixing chamber, the size of which can be changed by the position of the driving nozzle. Thus, it is assured that the mixture of material and compressed air produced in the mixing chamber is safely transported to the blast nozzle with respective speed.

The driving nozzle can be arranged such that it can be replaced to adapt it to various operating and material conditions.

It is advantageous when the evaluation unit consists of the following parts:

an abrasive advancement regulator with abrasive selection connected to a flow measuring device, a abrasive adjusting regulator 26 connected to the correlator, a control unit connected bi-directionally to the abrasive adjusting regulator 26 and uni-directionally to the abrasive selection of the correlator and to the variable drive of the reversible dosage auger.

Thus, it is possible to calibrate and program different abrasives with various weights by means of the abrasive selection. The control unit has the possibility to automatically call or select these different abrasives from the correlator. The abrasive adjusting regulator 26 assures that the blasting process is directly started with the preset nominal value. Thus, the blasting-in time is reduced about 35 seconds.

Siegel, Wolfgang: Pneumatische Fördertechnik, 1 Aufl. Vogel-Fachbuch Verfahrenstechnik, 1991 P. 187 ff., describes an injector type sluice consisting of 4 parts. A driving nozzle followed by a mixing chamber. The driving jet projected from the driving nozzle enlarges conically in the mixing chamber before it streams into a mixing tube. The produced kinetic energy of the air is converted to pressure in a subsequent diffusor. When the counterpressure in a subsequent transport line is small, the injector type sluice can act as a suction/pressure injector. However, the injector type sluice is only used as a pneumatic unit for the transport of goods out of tanks. By means of the described suction/pressure units corn can be unloaded from ships or PE-powder, foam polystyrol pearls and styrophil can be conveyed. Furthermore, the injector type sluice in the described construction is not suitable for blast machines.

Other objects, features, and characteristics of the invention will become apparent upon consideration of the following description and the appended claims with reference to the accompanying drawings, all of which form a part of this specification.

DETAILED DESCRIPTION OF THE PREFERRED EMBODIMENT

Figure 1:
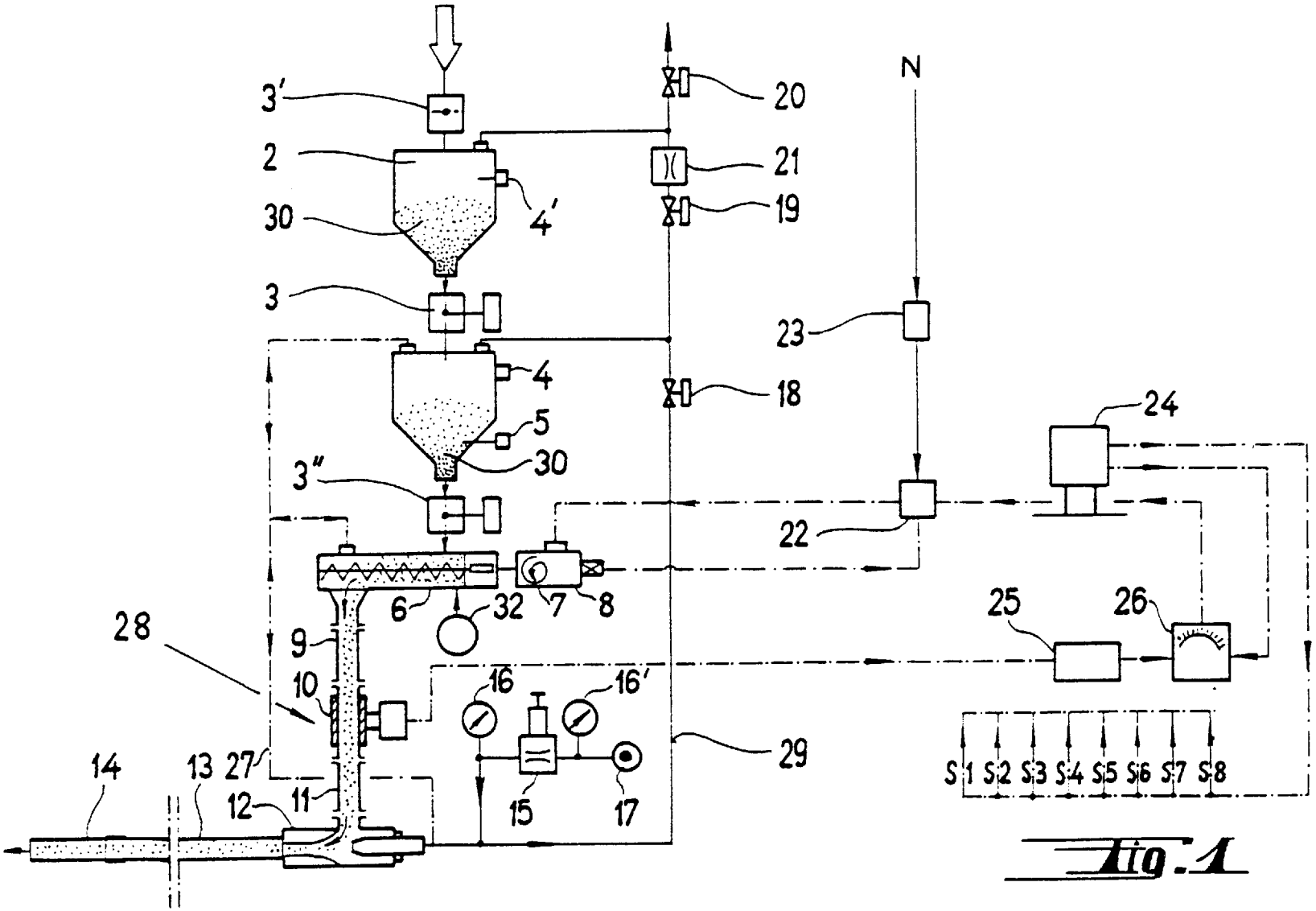
FIG. 1 is a blast installation according to the invention.

A blast installation according to the invention is shown in FIG. 1.

Reference numeral 1 refers to a lower vessel and 2 to an upper vessel. The upper vessel 2 is locked by a locking flap 3'. A locking flap 3 is arranged between the upper vessel 2 and the lower vessel 1. Both vessels have a hopperlike shape and are tightly closed by a cover. An abrasive 30, in the form of a grained, pourable material, is in the vessels. At the side of vessel 2 there is a maximum filling probe 4' that is able to determine the maximum filling level of the abrasive 30. In vessel 1 there is one maximum level probe 4 and a minimum level probe 5 that determine the maximum and minimum filling levels of abrasive in vessel 1, respectively. An abrasive feeding device 6 is arranged beneath vessel 1, separated by another locking flap 3".

Figure 5A:
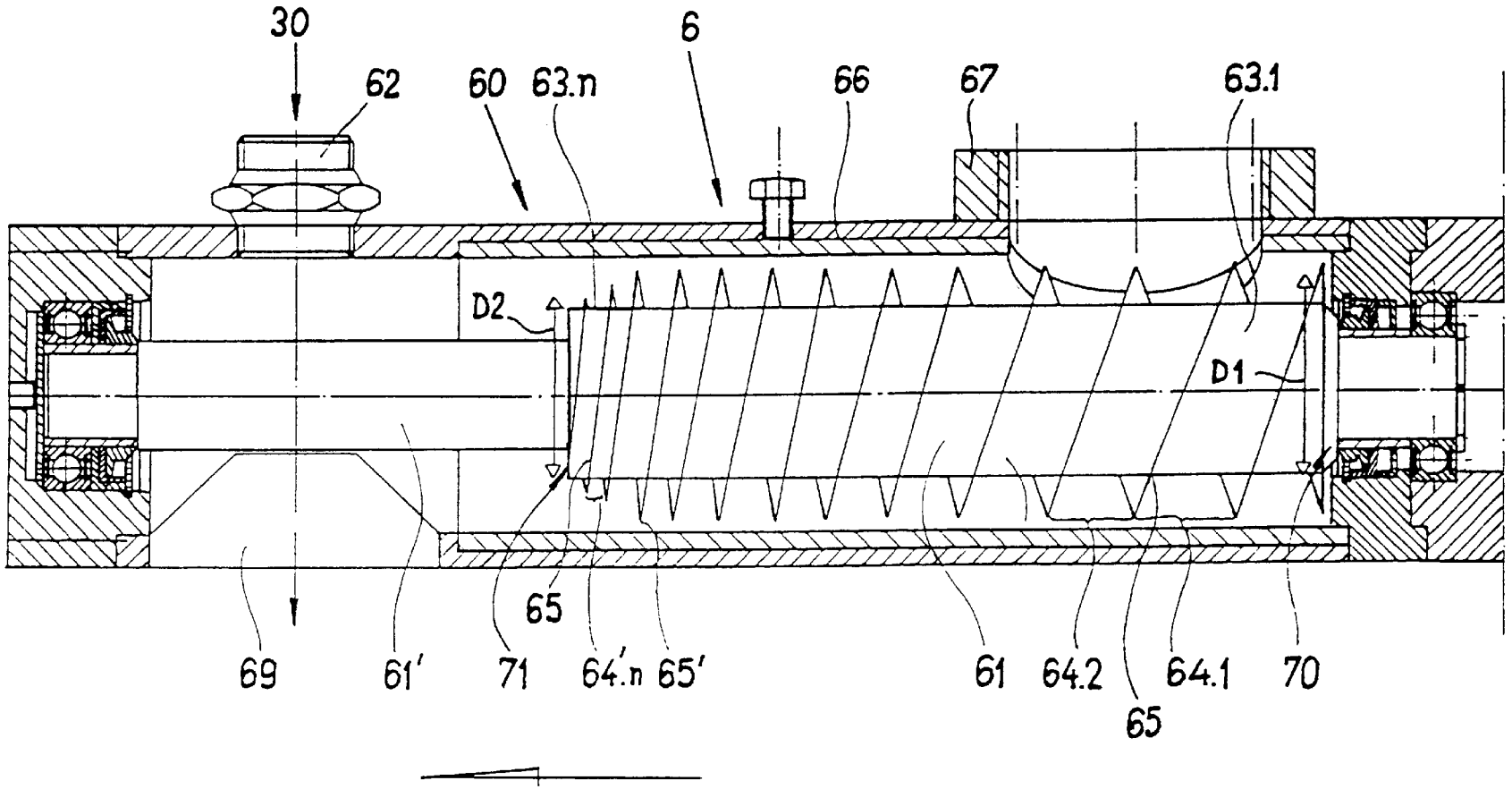
FIG. 5*a* and 5*b* are assembly variants of an abrasive dosage auger for a blast installation according to FIG. 1 in a schematic, sectioned layout.
Figure 5B:
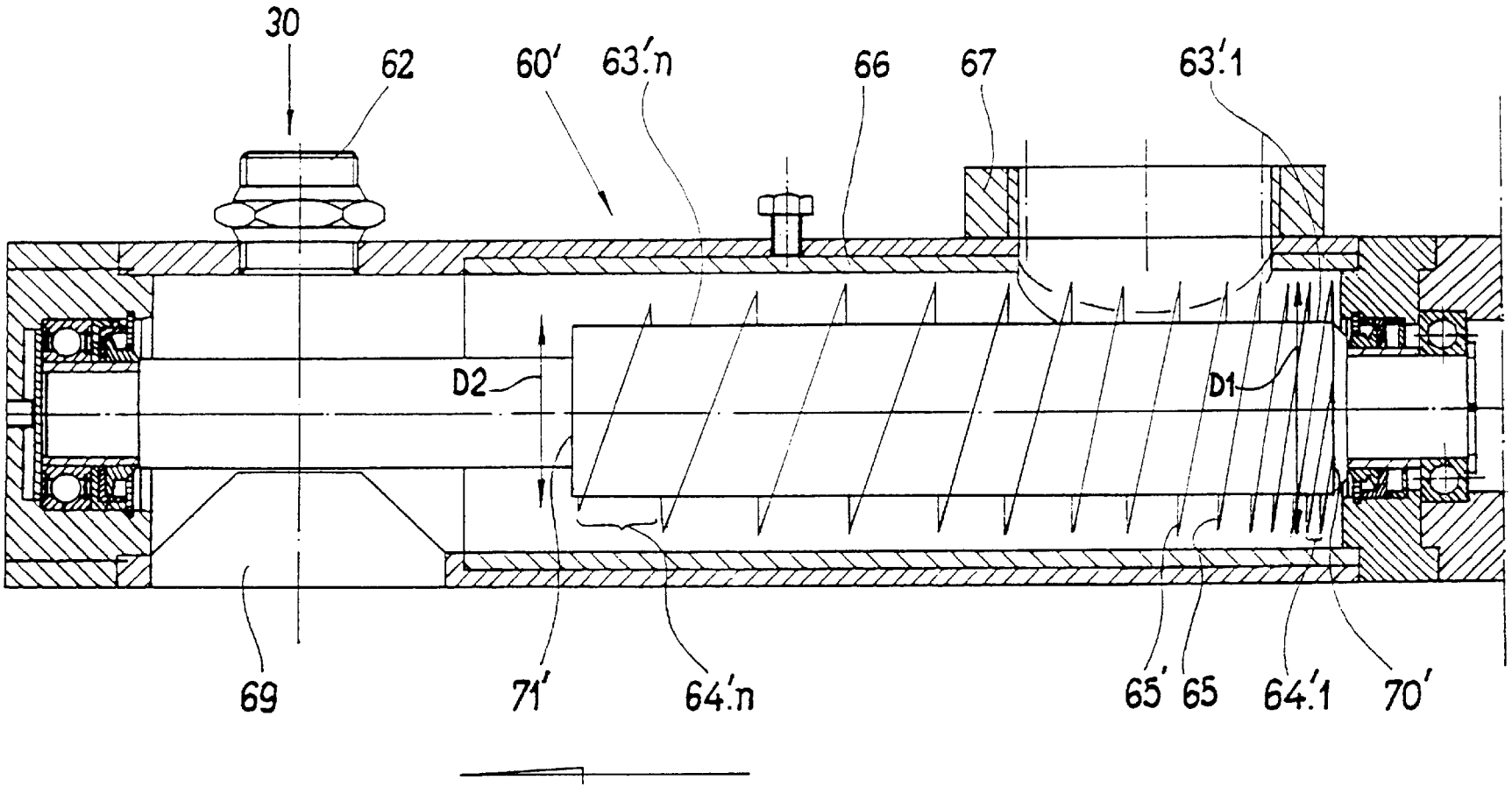

The abrasive feeding device, as shown in FIG. 5*a* and 5*b*, includes an auger tube 66 and a dosage auger 60, 60', respectively, that is rotatably mounted within auger tube 66'. The dosage auger 60 is supported by and fixed to an auger shaft 60, that is linked in a one piece manner to a turning shaft 61', together with auger wings 65 and 65' that comprise the threads of a helical screw.

The size of auger wings 65, 65' are relatively big at the beginning of the double spiral incline, compared to the size of those at the end of the double spiral incline 71, 71' at the opposite end. In FIG. 5*a* and 5*b* these diametered are defined as D1 and D2, respectively. The auger wings 65 and 65' are spaced apart by a wing distance that varies from 63.1 to 63.n. For a dosage auger 60 according to FIG. 5*a* it continuously diminishes with increasing incline and decreasing diameter from D1 to D2 in the transport direction. For a dosage auger 60' according to FIG. 5*b* the wing distance 63'.1 to 63'.n is opposite that of FIG. 5*a* and continuously increases with a decreasing incline and a decreasing diameter from D1 to D2. Thus, sections 64.1 to 64.n; 64'.1 to 64'.n each establish various volumes; these sections are defined by the double wings 65, 65', by shaft 61 and by the auger tube 66. The such described dosage auger 60, 60' is kept turnable in bearings 80 and 82 provided at opposite ends of the auger tube 66.

Auger tube 66 also includes a vessel connecting duct 67 which forms an infeed area for the abrasive 30 flowing from vessel 1 over the locking flap 3". At the opposite end of auger tube 66 is a tube connection 69 which forms an outfeed area for the abrasive 30 conveyed by the dosage auger. Concerning the invention it is important that the incline beginning 70 according to FIG. 5*a* as positioned under the vessel connecting duct 67 and that the opposite inclined end 71 be opposite to the tube connection 69 or similar, or that, as shown in FIG. 5*b*, the incline end 70' is positioned beneath the vessel connecting duct 67 while the inclined portions at 71' be positioned opposite to the tube connection 69.

The dosage auger 60, 60' of the abrasive feeding device 6 is driven, for example, by a DC motor 7. The DC motor 7 is provided with a gear, is under thyristor control or is designed as, geared motor. Furthermore, the DC motor 7 is linked to a speedometer 8 which assures that the speed of the dosage auger 60 is infinitely variable and movable to be nearly 100% synchronous with the set RPM.

A downpipe 28 is arranged at the tube connection 69. Downpipe 28 includes a forward area or lead section 9, a flow measuring device or flow through receiver 10 and an after run or tail area 11 arranged beyond the flow measuring device 10. The flow measuring device 10 uses for a measuring value record, a measuring value condensator. The absolute capacity change is caused by solid particles of the abrasive 30 per volume unit in the measuring condensator when compared to the previously measured empty tube capacity which is proportional to the abrasive flow rate. The capacity change caused by the abrasive flow rate is converted to a trouble safe pulse frequency modulation signal and transferred to a correlator 25 which is linked to an abrasive selection S1 to S8. This allows the calibration and programming of 8 different abrasives with variable bulk weights. A control unit 24 linked with the abrasive selection S1 allows the automatic selection of these 8 different abrasives 30 at the correlator 25. Furthermore, the control unit 24 is linked to an abrasive adjusting regulator 26. This is a microprocessor controlled universal regulator for measuring purposes. The control unit 24 is also linked with the abrasive advancement regulator 25 and via a 4-quadrant regulator 22 with the DC motor 7. The 4-quadrant regulator 22 is connected to net N by a transformator. It must be noted that the abrasive adjusting regulator 26 sets directly at the start the preset nominal value so that the blast-in time is reduced about 35 seconds.

It is important that a mixing chamber 12 is located beyond or downstream from the after run area 11 of the downpipe 28.

Figure 2:
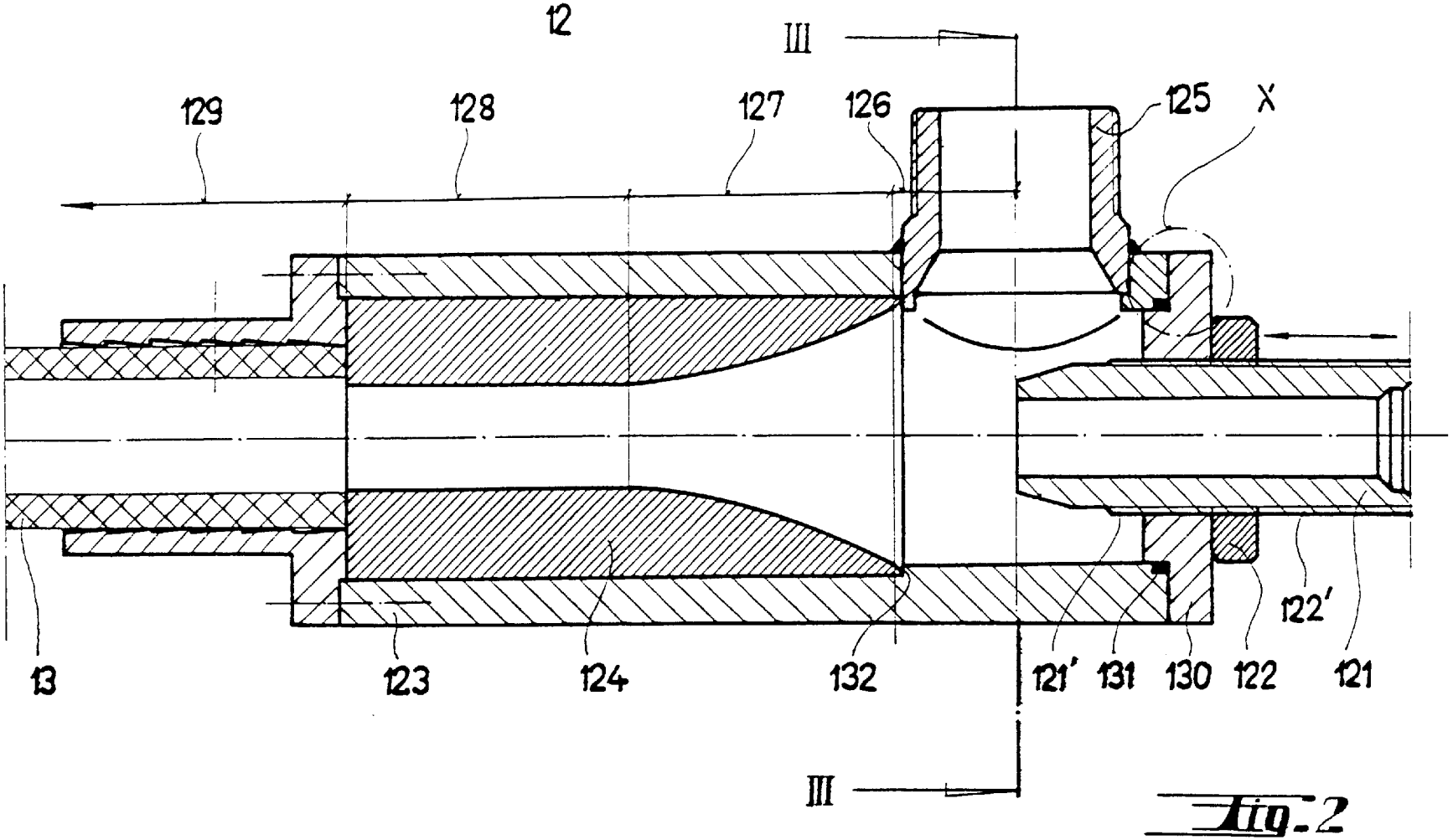
FIG. 2 is a mixing chamber for a blast installation according to FIG. 1 in a sectioned, schematic outline.
Figure 3:
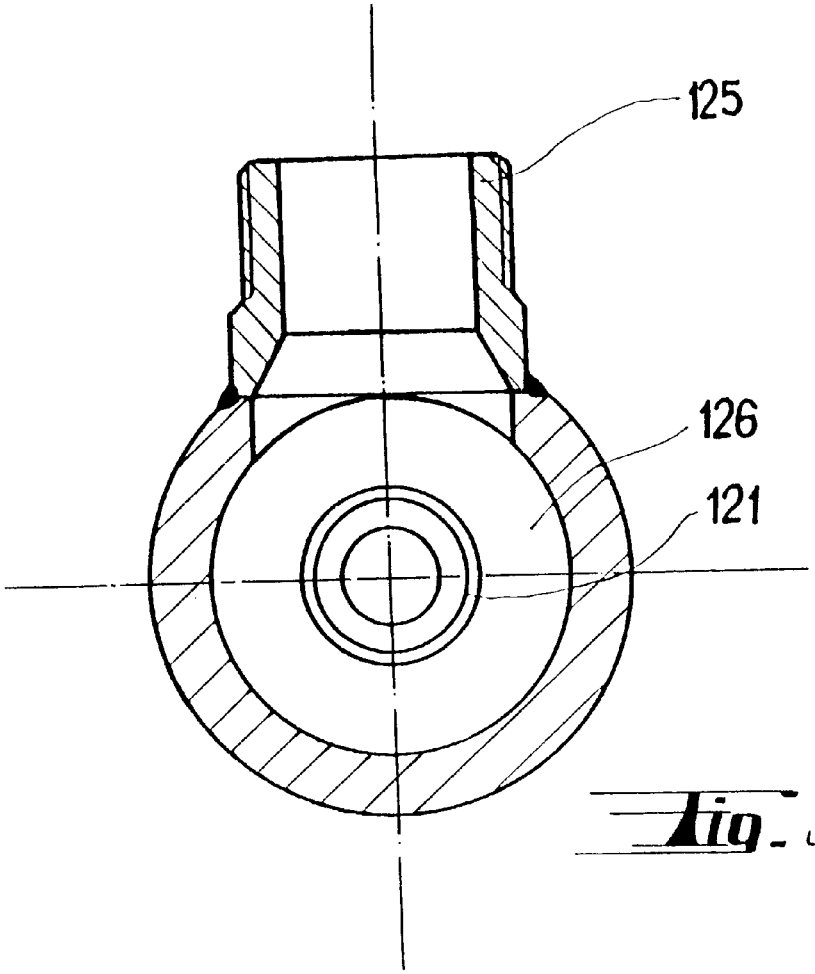
FIG. 3 is one section through a mixing chamber according to FIG. 2 along line III—III in a schematic outline.
Figure 4:
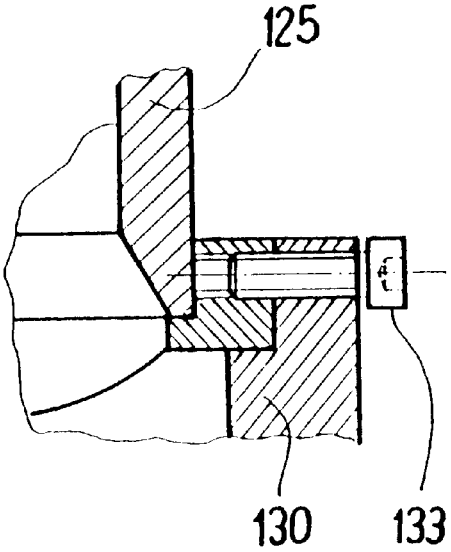
FIG. 4 is an enlarged layout of a section X of the mixing chamber shown in FIG. 3.

The mixing chamber is shown in detail in FIG. 2 and 3 and includes a chamber tube 123 on which a material feeding connection 125 is attached to which the after run area 11 of the downpipe is directly connected. The end of the chamber tube 123 is closed with a rear chamber wall 130 on which a threaded ring 122 is positioned. An adjustable driving nozzle 121 is led through the threaded ring 122 and through the rear chamber wall 130. In order to assure a stageless adjustment, it is provided with an outer thread 122'. In order to facilitate the replacement of the driving nozzle, the rear chamber wall 130 can be removed from chamber tube 123 by loosening the fixing screws 133 as shown in FIG. 4.

The driving nozzle 121 of the mixing chamber 12 is connected to a compressed air line 29. Compressed air line 29 is also connected to the lower vessel by a valve 18 and to the upper vessel 2 by another valve 19 and an air throttle 21. A depressurizing valve 20, arranged after the branch of vessel 2 in the compressed air line 29, secures the area of the other lines.

In order to have a contact and exact pressure of compressed air, a compressed air connection 17 is directly installed behind the driving nozzle 121 of the mixing chamber 12. This compressed air connection 17 feeds through a pressure regulator 15. The pressure of the air streaming into the driving nozzle is measurable by a manometer 16. A second pressure manometer 16' measures the pressure of the air downstream from pressure regulator 15 and from the connection 17.

A diffusor supply insert 124 is located at the opposite end of the chamber tube 123 from rear wall 130 which is followed by a blast hose 13 and a blast nozzle 14. In order to facilitate replacement of these parts, the diffusor supply insert 124 is linked to the vacuum tube 123.

The mixing chamber 12 is divided into the following areas by the described components:

- a mixing space which extends from the outlet of the driving nozzle 121 up to the beginning of the diffusor supply insert 124,
- a diffusor 127 which is conically reduced within the inner section of the chamber tube 123 to the inner diameter of the blast hose 13, a mixing tube area 128 which follows the diffusor 127, a conveying tube area which is defined principally by the blast hose 13.

The mixing space 126 can be adjusted by the changeable driving nozzle 121. It is designed such that the flowing losses are kept near zero. Thus, it is possible to convert the full pressure into speed energy. The kinetic energy is converted to pressure in the following diffusor area 127. In the following area of the mixing tube 128, there is good mixing between compressed air, supplied via driving nozzle 121, and the abrasive 30 entering through connection 125 so that an air/abrasive mixture leaves the mixing chamber 12 and arrives at the blast nozzle under high speed. This mixing assures that every grain of the abrasive develops its full efficiency.

A pressure balancing line 27 interconnects the vessel 1, the abrasive supply 6 and the compressed air line 29 entering the driving nozzle of a pressure balancing connection 62.

The pressure balancing line 27 assures that at all points where abrasive 30 flows, there is the same pressure. Thus, the feeding of secondary abrasive fed by eventual air movements is avoided.

The function of the blasting device is explained as follows, for example:

Abrasive 30 passes over the locking flap 3' in the upper vessel 2. The abrasive 30 flows to the hopperlike outlike of vessel 2 and arrives by the open locking flap 3 inside the lower vessel 1. The flowing abrasive will exceed the measuring space of the minimum filling probe 5 and afterwards that of the maximum level probe 4. When the measuring point of the maximum probe 4 is exceeded, the locking flap 3 is closed by a conventional drive. The blast process starts by opening of locking flap 3". Hereby abrasive 30 flows to the abrasive feeding device 6.

In case of a dosage auger 60 positioned according to FIG. 5*a* the abrasive 30 arrives via the vessel connecting duct onto the beginning of the spiral wing incline 70. According to the speed of the dosage auger 60 and to the first wide section 64.1, the abrasive is transported by rotation in the subsequent sections up to section 64.n (in FIG. 5*a* to the left). When arriving at the end of the spiral wing incline 71 the abrasive already starts leaving in the last sections 64 and completely leaves the auger in its last section. The conical tapering at the end of the dosage auger serves for a uniform outlet of the spiral wings 65, 65'.

If a hygroscopic, not pourable, aluminum oxide 320 is used instead of the grained, round and pourable abrasive 30 there will be a clogging of this abrasive when the dosage auger used is according to FIG. 5*a*. The aluminum oxide 320 falling on the side sections 61, is more and more compressed as it moves toward the narrowing sections 64.n so that strips are created at the end of the spiral wing incline 71 which fall down as lumps by the rotation of the dosage auger and are not suitable for further use.

In order to allow for the positive use of aluminum oxide 320, or other abrasives 30 with flour like configuration, the dosage auger 60 is taken out and the dosage auger 60', as described and shown in FIG. 5*b*, is installed. In this case, the flour like aluminum oxide 320 arrives at the narrow sections 64'.1 at the beginning of the spiral wing incline 70'. The sections become larger, and thus, the rotating dosage auger 60' effects a loosening and pulverization, i.e., a separation of single grains of the aluminum oxide from a coherent pile. This is accomplished by using the enlarging sections from 64'.1 towards 64'.n with the aluminum oxide 320 lying as a spread abrasive 30 on the base of the auger shaft 61 of the dosage auger 60'. In combination with rotation of the dosage auger, the separation of the single grains is effected.

The positioned and separated abrasive 30 arrives at the tube connection 69. Here, the abrasive 30 falls through the downpipe 28. Due to the reversed incline of the dosage auger 60' the aluminum oxide has no more lumps and, thus moves with a uniform flow. The same is also valid for pourable abrasives.

In the forward area 9 the abrasive 30 moves at a respective, uniform speed. While passing the flow measurer 10, a signal is created by the capacity change and transferred via the abrasive adjusting regulator 26 to the abrasive advancement regulator which sets the dosage auger 60/60' such that the necessary quantity of abrasive arrives at the material feeding connection 125 of the mixing chamber 12 and then falls into the mixing space 126. In the mixing space 126 the abrasive 30 is carried along by the compressed air leaving the driving nozzle 121 and drives into the diffusor area 127 of the diffusor supply insert 124. In the diffusor area 127, the abrasive 30 and the compressed air achieve the necessary speed which can be regulated by the position of the driving nozzle 121 in the mixing space 126. The abrasive and compressed air are whirled up in the following mixing tube area 128. Since there is no laminar, but a turbulent flow in this section, it is observed that each grain of the abrasive 30 is fully separated even when it has the negative flowing features of the aluminum oxide 320. The abrasive/compressed air mixture is projected with a very high speed through the blast nozzle 14. As described above, this speed can be regulated by the position of the driving nozzle 121.

The pressure balancing line 28 assures that there are the same pressures in vessel 1, in the media feeding unit 6 and in the blast chamber 12. If the abrasive quantity is reduced, it can be refilled from the upper vessel 2 by opening the locking flap 3 without interruption of the blast process.

Reproducible results are always assured by the combination of vessel 1 and 2, the special design and positioning of the dosage auger 60/60' in the abrasive feeding unit 6, the quantity determination and control in the downpipe 28 and the directed acceleration in the mixing chamber 12 shown in FIG. 2 and 3.

In order to assure reproducibility when using a new abrasive the residues of the abrasive 30 of the former blast process must be completely removed from the unit. For this, the blast unit is "rinsed" with compressed air via the connection 32. In order to also perform this rinsing in the abrasive feeding unit 6, the dosage auger 60/60' is positioned in the auger tube 66 such that one end of the spiral wing incline 71/71' is opposite the vessel connecting duct 67 and the beginning of the spiral wing incline is positioned adjacent the tube connection 69 (see FIG. 5*b*). Thus, in dosage auger 60, and in dosage auger 60', there is no resistance against the compressed air used for the rinsing process. The reversed positioned incline of the spiral wings 65, 65' even supports the rinsing effect of the compressed air so that it is assured that all residues of the former abrasive 30 are removed from the dosage auger 60/60'. This is always important when flour like abrasives are used. Even when the single sections with reversed dosage auger position become larger, abrasive residues can stick in the corner areas. The effective rinsing by compressed air avoids a mixture of these residues with an abrasive of different configuration and assures the reproducibility of the single blast parameters.

During the single blast processes, the driving nozzle is subject to wear. The sharp edges shown in FIG. 2 and 3 become rounded which can cause a change in the speed of the compressed air/abrasive mixture. In this case, the driving nozzle 121 is turned out and replaced. If the thread is worn, too, the whole rear chamber wall 130 is loosened from the mixing tube 128 by the fixing screw 133 (see FIG. 4) and replaced by a new rear chamber wall 130 with threaded ring 122 and a new driving nozzle 121. Such a general change can also be performed when the production of other speeds are necessary by the installation of a driving nozzle with a different interior diameter.

A test run is performed before the use of a new abrasive 30 so that the blast unit can work with great efficiency and high accuracy. Based on gained experience, the dosage auger 60 or 60' is installed and its expected turning speed is preset. Then, the driving nozzle is set to the correct position in order to give the mixing space 126 the desired size for the desired drive to be effected for the abrasive 30. When the correct position of the driving nozzle 121 has been determined, it will be fixed so that changes cannot occur during subsequent working operations.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A unit for the dosage of grained, pourable materials through an abrasive hose to a blast nozzle comprising:

at least one closed vessel for holding a stock of grained, pourable materials;

an abrasive feeding unit connected to said at least one closed vessel by an infeed area, said abrasive feeding unit including a dosage device driven by an adjustable drive and an outfeed area operatively connected to a down pipe, said down pipe opening into a mixing chamber connected to said downpipe opposite said outfeed area, said mixing chamber comprising a chamber tube which is enclosed at one end by a rear chamber wall in which an adjustable compressed air driving nozzle is mounted to protrude through said rear chamber wall into said mixing chamber adjacent an inflow point of material into said mixing chamber, a diffusor insert arranged to extend along at least a portion of the interior of the chamber tube opposite from the rear chamber wall, said abrasive hose being connected to said diffuser insert;

a flow measuring device to generate an output signal corresponding to material flow through said down pipe; and an evaluation unit linked to the flow measuring device and the adjustable drive to regulate said adjustable drive in response to a comparison of said output signals to a preset nominal value to thereby provide a uniform and controllable flow rate of the material from the blast nozzle.

2. The dosage unit of claim 1, wherein said dosage device comprises a dosage auger with a double spiral configuration inclining toward the outfeed area that can be reversed and which tapers from one end of said incline to an opposite end of said incline.

3. The dosage unit of claim 2, wherein the incline of the spiral configuration and the distance between spirals of said dosage auger continuously decreases from one end of said incline to said opposite end of said incline.

4. The dosage unit of claim 3, wherein the orientation of the beginning and the end of the dosage auger within the abrasive feeding unit beneath the infeed area is reversible.

5. The dosage unit of claim 2, wherein the incline of the spiral configuration and the distance between spirals of said dosage auger continuously increases from said one end of said incline to said opposite end of said incline.

6. The dosage unit of claim 5, wherein the orientation of the incline of the dosage auger within the abrasive feeding unit beneath the infeed area is reversible.

7. The dosage unit of claim 6, wherein a pressure balancing line is linked to a first vessel of said at least one closed vessel, to a pressure balancing connection of the abrasive feeding unit and to the driving nozzle of the mixing chamber.

8. The dosage unit of claim 7, wherein a second vessel is arranged above said first vessel and connected thereto.

9. The dosage unit of claim 8, wherein said first vessel, said second vessel and said driving nozzle are connected to a compressed air line.

10. The dosage unit of claim 9, wherein a threaded ring is arranged at the rear chamber wall and an outer thread is arranged on the driving nozzle, said outer thread for connecting said driving nozzle to said thread ring of said rear chamber wall.

11. The dosage unit of claim 10, wherein a connecting point between the downpipe and the chamber tube is a material supply connection or a material supply double hopper.

12. The dosage unit of claim 11, wherein the diffusor insert is divided into a mixing space which is adjustable by the driving nozzle, a diffusor next to the mixing space, and a subsequent mixing tube area next to the diffusor.

13. The dosage unit of claim 12, wherein said driving nozzle is removably mounted.

14. The dosage unit of claim 13, wherein the evaluation unit comprises:

an abrasive advancement regulator with an abrasive selection, connected to the flow measuring device, an abrasive adjusting regulator linked with the abrasive advancement regulator, a control unit which is bi-directionally linked to the abrasive adjusting regulator and uni-directionally linked to the abrasive selection of the abrasive advancement regulator and to the adjustable drive of the dosage device.

15. The dosage unit of claim 1, wherein said dosage device is a vibrating conveyor.

16. An abrasive feeding unit for use in a dosage unit for feeding grained, pourable materials comprising:

an infeed at one end of said feeding unit and an outfeed at an opposite second end of said feeding unit;

a dosage device driven by an adjustable drive wherein said dosage device comprises a dosage auger with a varying pitch spiral configuration wherein a distance between spirals increases from an infeed area to an outfeed area for the dosage of grained, pourable materials, and wherein the orientation of said dosage auger within said feeding unit is reversible so that in a reverse orientation, the distance between spiral wings on said auger decreases from said infeed area to said outfeed area;

a flow measuring device for measuring a flow of material from said feeding unit and producing a flow signal; and an evaluation unit in communication with said flow measuring device and said adjustable drive, wherein said evaluation unit evacuates the flow signal and regulates the adjustable drive.

17. The abrasive feeding unit of claim 16, wherein a diameter of said spirals of said dosage auger increases from the infeed area to the outfeed area when the distance between spirals increases from the infeed area to the outfeed area.

18. The abrasive feeding unit of claim 16, wherein a diameter of said spirals of said dosage auger decreases from the infeed area to the outfeed area when the distance between said spirals decreases from the infeed area to the outfeed area.

19. The abrasive feeding unit of claim 16, wherein said abrasive feeding unit is pressurized.

* * * * *